US005623900A

United States Patent [19]

Töpfer et al.

[11] Patent Number: 5,623,900

[45] Date of Patent: Apr. 29, 1997

[54] INTERNAL-COMBUSTION ENGINE COMPRISING AN INTAKE SYSTEM

[75] Inventors: Walter Töpfer, Iptingen; Franz Eberle, Stuttgart; Dietmar Krüger, Friolzheim; Norbert Kleinehakenkamp, Weissach, all of Germany; Michail I. Fesina, Togliatti, Russian Federation; Rudolf N. Starobinskij, Togliatti, Russian Federation; Jurij P. Lasarev, Togliatti, Russian Federation; Evgenij V. Lysenko, Togliatti, Russian Federation

[73] Assignees: Dr. Ing. h.c.F. Porsche AG, Weissach, Germany; Avto-Waz Volga Automovile Associated Works, Togliatti, Russian Federation

[21] Appl. No.: 387,912

[22] PCT Filed: Aug. 22, 1992

[86] PCT No.: PCT/EP92/01930

§ 371 Date: Jul. 7, 1995

§ 102(e) Date: Jul. 7, 1995

[87] PCT Pub. No.: WO94/04816

PCT Pub. Date: Mar. 3, 1994

[51] Int. Cl.[6] ..... F02M 35/10

[52] U.S. Cl. ..... 123/184.42; 123/184.47

[58] Field of Search ..... 123/184.42, 184.47, 123/184.38, 184.53

[56] References Cited

U.S. PATENT DOCUMENTS

| | | | |
|---|---|---|---|
| 1,818,283 | 8/1931 | Spencer | 123/184.38 |
| 2,740,389 | 4/1956 | Reyl | 123/184.42 |
| 4,064,696 | 12/1977 | Cser | 123/184.42 |
| 4,543,918 | 10/1985 | Ma | 123/184.42 |
| 4,640,256 | 2/1987 | Conrad et al. | 123/184.38 |
| 5,537,965 | 7/1996 | Topfer et al. | 123/184.42 |

FOREIGN PATENT DOCUMENTS

| | | | |
|---|---|---|---|
| 1238718 | 4/1967 | Germany | 123/184.38 |
| 2527774 | 12/1976 | Germany . | |
| 3219699 | 12/1983 | Germany . | |
| 3742057 | 9/1988 | Germany . | |
| 9113807 | 2/1992 | Germany . | |
| 60-116812 | 6/1985 | Japan . | |
| 968494 | 10/1982 | U.S.S.R. | 123/184.53 |
| 162934 | 11/1920 | United Kingdom . | |

*Primary Examiner*—David A. Okonsky

*Attorney, Agent, or Firm*—Evenson McKeown Edwards & Lenahan PLLC

[57] ABSTRACT

An internal-combustion engine comprising an intake system has a chamber with an intake connection and individual suction pipes which are connected with a cylinder head and which, by means of valves, lead into the individual cylinders. An air supply and air purification system is connected with the intake connection. An air guiding pipe is connected with the intake connection of the chamber, which air guiding pipe projects freely into the chamber and is arranged coaxially with respect to it. The mouth opening of the air guiding pipe extends in a plane at a right angle with respect to the lateral wall of the chamber and has an identical distance to the center axes of the individual suction pipes of a second and third cylinder of the internal-combustion engine.

9 Claims, 2 Drawing Sheets

INTERNAL-COMBUSTION ENGINE COMPRISING AN INTAKE SYSTEM

BACKGROUND AND SUMMARY OF THE INVENTION

The invention relates to an internal-combustion engine comprising an intake system which consists of a chamber with an intake connection and individual suction pipes which are connected with a cylinder head and which lead into the individual cylinders by means of valves, an air supply and air purification system being connected with the intake connection.

Because of a variable air flow rate to the individual cylinders in the cylinder head, airborne noises occur in an intake system of an internal-combustion engine which are transmitted to the outside by way of the chamber of the system and other components and represent an acoustic deterioration of the comfort.

It is an object of the invention to provide an internal-combustion engine comprising an intake system in which a reduction of airborne noises is carried out.

According to the invention, this object is achieved by an arrangement wherein an air guiding pipe is connected with the intake connection of the chamber, which air guiding pipe projects freely into the chamber by way of a pipe connection and is arranged coaxially with respect to this pipe connection, the mouth opening of the air guiding pipe extending in a plane which extends between the two individual suction pipes and has an identical distance from the center axes of the individual suction pipes of a second and third cylinder of the internal-combustion engine.

For reducing airborne noises, an air guiding pipe is provided in the chamber of the intake system which, on the inlet side, is fastened to the intake connection of the chamber and projects freely into the chamber. This chamber ensures a distributed charging of the cylinders because of the essential separation of the connections by the volume of the chamber. On the other hand, the mutual independence of the wave effect in the individual suction pipes of the cylinders results in a more defined development of the gas-resonance vibrations in each individual suction pipe.

Because of the asymmetry of the acoustic loads generated by the chamber, the loads on the individual suction pipes of the individual cylinders will differ and there will be a lower non-match of the resonance frequency in the separate individual suction pipes. Therefore, the resonance vibrations (on their resonance frequency), which arise in one of the cylinders, are not damped by the vibrations which occur in the chamber as a result of the individual suction pipes and even when the starting pulses are compensated by the cylinders. The reason is that they move in antiphase. The second unfavorable phenomenon is connected with the excitation of the first asymmetrical form of the gas vibrations in the chamber. Their frequency is regularly close to a natural frequency of the gas vibration in the individual suction pipe, which leads to an intensive sound radiation from the system, particularly on the frequencies which coincide with the non-linear harmonic of the primary frequency of the intake process.

For eliminating this disadvantageous phenomenon, an air guiding pipe is inserted into the chamber which is arranged coaxially to a center axis with the center axis of the chamber space and, on the inlet side, is fastened in the intake connection of the chamber. This intake connection connects the chamber with the air supply and air purification system.

The mouth opening of the air guiding pipe provided in the chamber is situated in a plane which is arranged perpendicularly to the lateral wall of the chamber and which has approximately the same distance from the center axes of the individual suction pipes of the second and third cylinder.

The free end of the air guiding pipe may be partially perforated or have radial flow-through openings.

The presence of an air guiding pipe arranged in a certain manner has the result that the acoustic load on the cylinders which operate in antiphase is symmetrical and eliminates the asymmetrical excitation in the lowest frequencies.

In addition, the mouth opening of the air guiding pipe is situated in the proximity of a node (crossover) of a first natural gas vibration of the chamber of the intake system. As a result, it is also prevented in the case of a resonance excitation that a transmission of the acoustic energy takes place by means of the air guiding pipe in the direction of the inlet mouth and therefore to the environment.

Other objects, advantages and novel features of the present invention will become apparent from the following detailed description of the invention when considered in conjunction with the accompanying drawings.

DETAILED DESCRIPTION OF THE DRAWINGS

Figure 1:
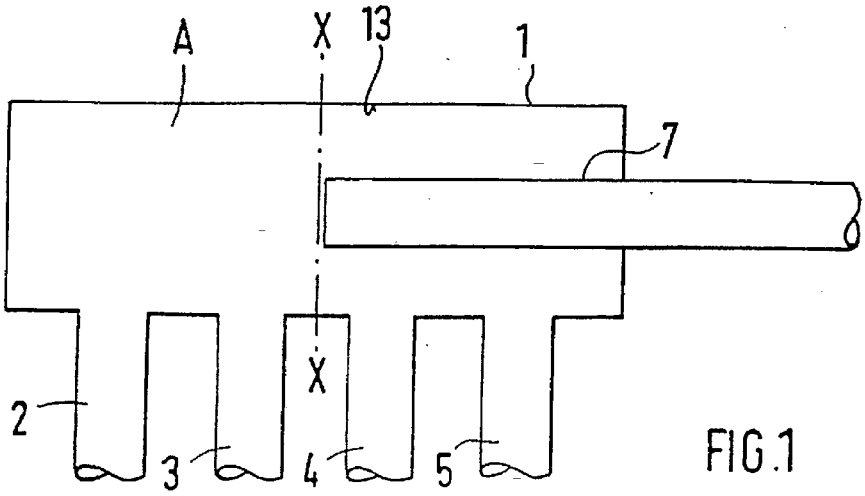
FIG. 1 is a schematic representation of a chamber of an intake system with outgoing individual suction pipes and an inserted air guiding pipe.

The internal-combustion engine comprises an intake system with a chamber 1 whose interior A is connected by way of individual suction pipes 2, 3, 4 and 5 to a cylinder head Z. An air guiding pipe 7, which projects freely into the chamber and is connected to an air supply system 8 (throttle valve) or to an air purification system 9 (filter), is connected to an intake connection 6 of the chamber 1.

On the inlet side, the air guiding pipe 7 is fixedly connected with the intake connection 6 of the chamber 1, the throttle valve 8 being arranged between the free end of the connection 6 and the adjoining pipe line 10. A filter 9 is provided upstream of this pipe line 10.

The pipe 7 is arranged coaxially to the chamber 1; that is, the center axis 11 of the chamber 1 corresponds to the center axis of the air guiding pipe 7. In particular, the mouth opening 12 of the pipe 7 extends approximately in a plane X—X which extends perpendicularly to a lateral wall 13 of the chamber 1. This plane X—X is arranged between the central individual suction pipes 3 and 4, and the mouth opening 12 is provided at an identical distance a from the center axes 14, 15 of the individual suction pipes 3 and 4 for the second and third cylinder.

Figure 2:
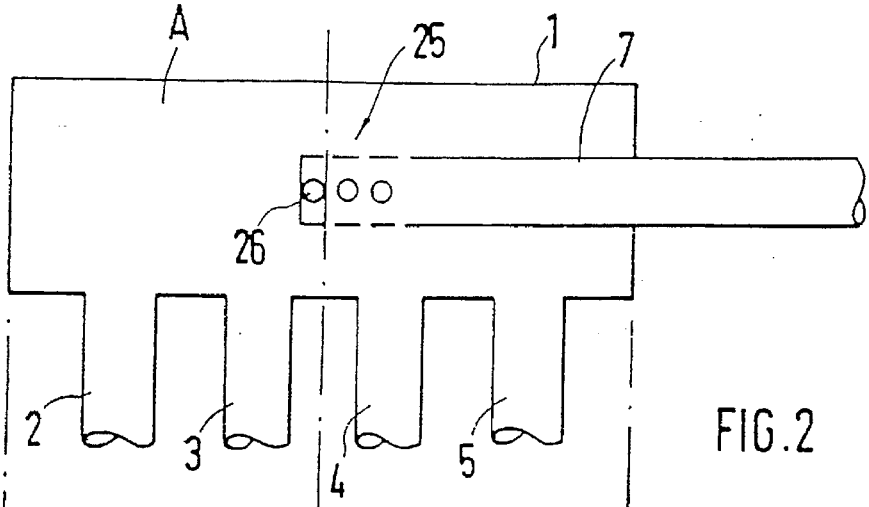
FIG. 2 is a view of a construction of the air guiding pipe with radial flow-through openings.
Figure 3:
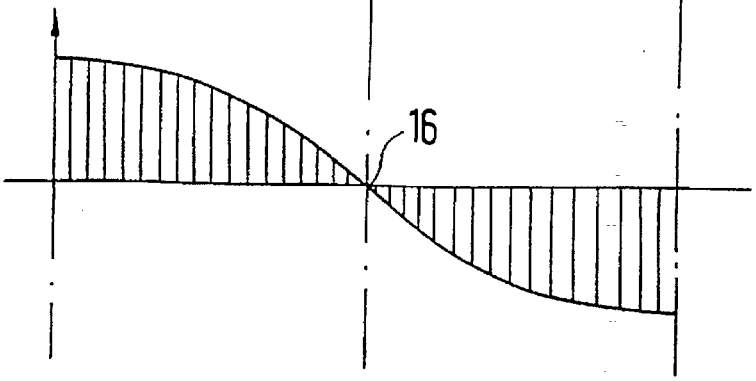
FIG. 3 is a diagram with the representation of a first natural gas vibration with the node (crossover)
Figure 4:
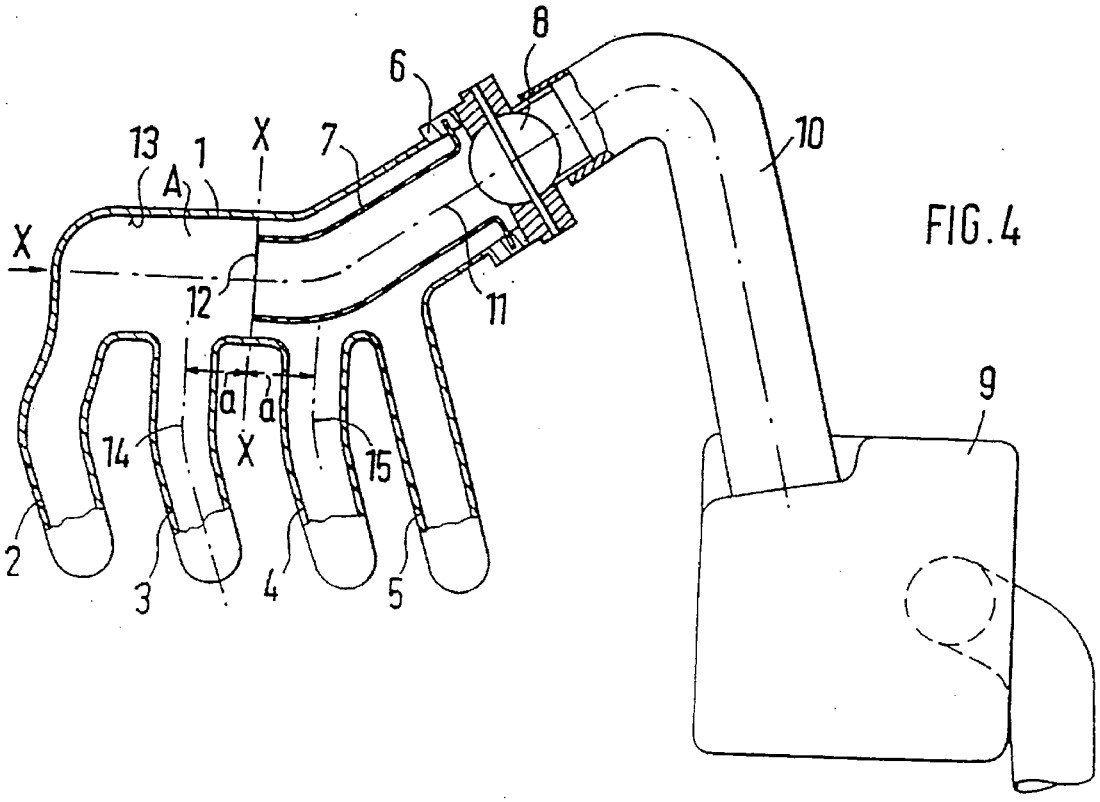
FIG. 4 is a sectional representation of the chamber of the intake system with individual suction pipes, the air guiding pipe and the air guiding and air purification system.
Figure 5:
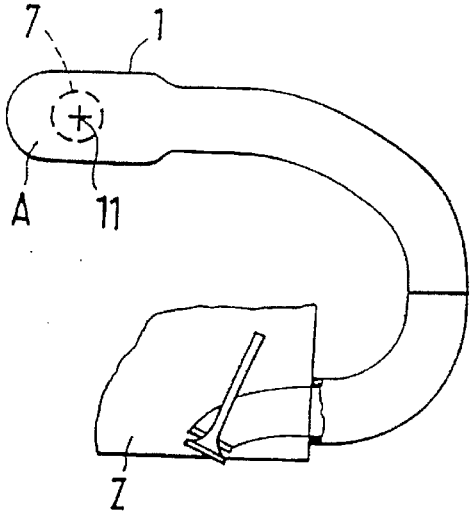
FIG. 5 is a view of the chamber of the intake system in the direction of the arrow X.

Preferably, the mouth opening 12 of the air guiding pipe 7 is arranged in the area of a node 16 (crossover) of a first natural gas vibration in the chamber 1, which can be recognized in detail in FIG. 3 in conjunction with FIG. 2. The plane X—X, in turn, extends through this node 16.

As illustrated in detail in FIG. 2, the free end of the air guiding pipe 7 may be perforated and have, in addition to the mouth opening 14, radial flow-through openings 26 in different configurations. These openings 26 may be distributed along the pipe circumference or may be arranged to extend only along certain sections of the circumference.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An internal combustion engine intake system comprising, an intake chamber, a plurality of individual suction pipes connecting the intake chamber with a cylinder head and respective individual cylinders by way of valves, an intake connection connecting an air supply system to the intake chamber, and an air guiding pipe connected with the intake connection, said air guiding pipe projecting freely into the chamber and being arranged coaxially with respect to the intake connection, a mouth opening of the air guiding pipe in the chamber extending in a plane located between two centrally disposed individual suction pipes at an identical distance from center axes of said two individual suction pipes.

2. An intake system according to claim 1, wherein four suction pipes are connected to the chamber and respective first through fourth cylinders arranged adjacent one another, and wherein said two individual suction pipes are for respective second and third cylinders of the engine.

3. An intake system according to claim 1, wherein said air guiding pipe includes at least one radial flow opening adjacent its free end projecting into the chamber.

4. An intake system according to claim 2, wherein said air guiding pipe includes at least one radial flow opening adjacent its free end projecting into the chamber.

5. An internal combustion engine intake system according to claim 1, wherein the mouth opening of the air guiding pipe is arranged in an area of a crossover node of a first natural gas vibration in the chamber, which node is located in a plane intermediate the two individual suction pipes.

6. An intake system according to claim 3, wherein the mouth opening of the air guiding pipe is arranged in an area of a crossover node of a first natural gas vibration in the chamber, which node is located in a plane intermediate the two individual suction pipes.

7. An intake system according to claim 2, wherein the mouth opening of the air guiding pipe is arranged in an area of a crossover node of a first natural gas vibration in the chamber, which node is located in a plane intermediate the two individual suction pipes.

8. An internal combustion engine intake system according to claim 1, wherein said air guiding pipe extends in said chamber substantially co-axially with a central axis of the chamber over fits entire length.

9. An internal combustion engine intake system according to claim 1, wherein said air supply system includes an air purification system.

* * * * *